United States Patent [19]

Collier

[11] Patent Number: 4,743,023

[45] Date of Patent: May 10, 1988

[54] MAZE GAME

[75] Inventor: David L. Collier, Portland, Oreg.

[73] Assignee: Collier Products, Inc., Portland, Oreg.

[21] Appl. No.: 917,769

[22] Filed: Oct. 10, 1986

[51] Int. Cl.[4] ..... A63B 67/14; A63F 9/06

[52] U.S. Cl. ..... 273/113; 273/153 R

[58] Field of Search ..... 273/113, 153 R, 115, 273/153 J

[56] References Cited

U.S. PATENT DOCUMENTS 3,785,651 1/1974 Smith ..... 273/153 R 4,065,132 12/1977 Giakas ..... 273/153 R

FOREIGN PATENT DOCUMENTS 3220532 12/1983 Fed. Rep. of Germany ..... 273/113

*Primary Examiner*—Richard C. Pinkham

*Assistant Examiner*—Gary Jackson

*Attorney, Agent, or Firm*—Olson and Olson

[57] ABSTRACT

A multi-dimensional ball-type maze puzzle game comprises a plurality of individual, maze containing modules secured together to form a vertical stack, aligned openings being provided at selected points through the modules for interconnecting the interiors of adjacent modules in the stack whereby to permit an object ball to pass from maze level to maze level upon successful completion of the maze associated with the preceding level. Locking clips are provided to secure the modules in closed, operative condition, and to secure adjacent modules together in a vertical stack.

6 Claims, 2 Drawing Sheets

MAZE GAME

BACKGROUND OF THE INVENTION

This invention relates to puzzles, and more particularly to a novel, multi-level maze puzzle game comprising a plurality interconnecting maze-containing levels forming a complex, expandable game.

It is becoming increasingly more popular in todays marketplace to provide more difficult and intriguing multi-level and multi-dimensional games to challenge the skills of more advanced players. Tic tac toe, chess and checkers are but a few examples of games that have enjoyed revived popularity once placed into a three-dimensional environment.

Mazes have been known for centuries, and maze puzzle games in which a maze containing box is tilted and manipulated by a user to direct a ball or marble through a preset course have been popular for many years. Still, it is an object to add versatility and challenge to the game, and strive to devise more and more ways to peak a gamester's curiosity, interest and indeed, frustration.

The present invention is believed to satisfy many needs in this regard, as well as being expandable to permit users of virtually all skill levels to enjoy working a maze that is challenging to the player regardless of his ability.

The Applicant is not aware of any multi-level, expandable maze puzzle game similar in objective or construction to the present invention.

SUMMARY OF THE INVENTION

In its basic concept, this invention provides a plurality of module levels each configured to contain a multitude of interior maze forming panels that are releasably received within the modules and arrangeable to form a virtually limitless variety of maze pathways throughout the level, the plurality of maze containing modules configured to be stacked one upon another with openings arranged to permit passage of a ball successively from one level to the next upon successful completion of the maze associated with the one.

It is by virtue of the foregoing basic concept that the principle object of this invention is achieved; namely, the provision of a stackable, multi-level maze game having any desired number of interconnecting maze levels and maze courses for players of various and improving skill levels.

Another object of this invention is the provision of a maze game of the class described which is configured to be expandable by the simple addition of additional maze containing modules to increase the complexity of the game.

A further object of this invention is the provision of a maze game of the class described in which each maze module includes a contoured surface configured to releasably engage a corresponding contoured surface of a vertically adjacent module in a manner which facilitates alignment of the modules relative to each other for proper positioning of interconnecting openings therebetween in order that a marble may pass between maze levels upon completion of a maze course.

A further object of this invention is the provision of a maze game of the class described which includes specially configured locking clips arranged to secure each module against inadvertent separation and subsequent loss of maze forming panels, and also secures each completed maze-containing module releasably to its next adjacent completed maze containing module, whereby a vertical stack of individual maze containing modules can be secured rigidly together to form a plurality of interconnected vertically disposed levels of individual mazes.

A still further object of this invention is the provision of a maze game of the class described which is of simplified construction for economical manufacture.

The foregoing objects and advantages of the present invention will appear from the following detailed description, taken in connection with the accompanying drawings of a preferred embodiment.

DESCRIPTION OF A PREFERRED EMBODIMENT

As will be understood from the following description, the game of this invention comprises, in essence, a plurality of hollow containers that are configured to be stacked one upon another and releasably secured together, each hollow container holding a plurality of panels which are positioned to provide a maze pathway through the interior of the container, and each container including openings arranged to align with the openings of adjacent containers and thereby interconnect the interiors of adjacent containers so that an object ball may move from one container to an adjacent container upon completion of a maze course. Accordingly, with this general construction in mind, it is readily apparent that this invention provides a plurality of interconnecting individual maze levels in which one maze level must be successfully completed in order to proceed to the next maze, and the next, and so forth in order to exit the game at the opposite end.

Not only does the invention provide an extensive maze network in a compact area, but it produces a more challenging game to the player by having to determine and navigate maze pathways in lower containers by viewing through the maze containing containers that comprise a game stack. Clearly, the more containers in a stack, the more complex and intriguing is the game.

Figure 1:
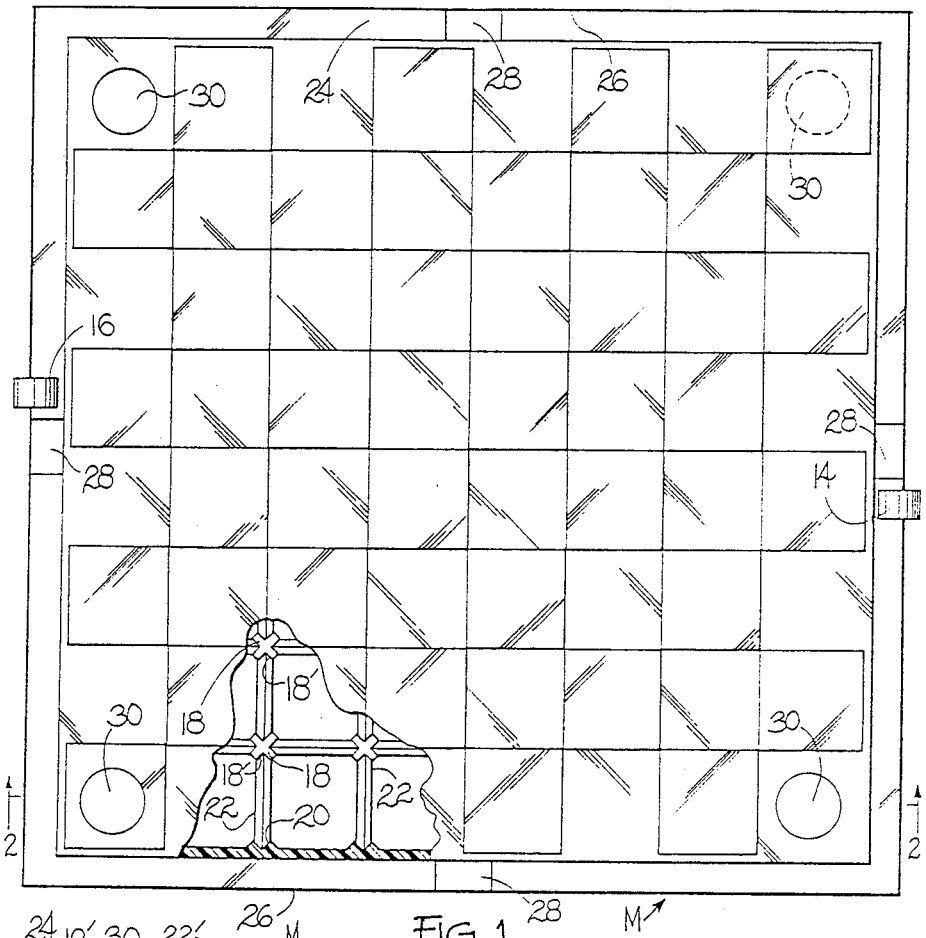
FIG. 1 is a plan view of the top side of the uppermost maze containing module of a maze game embodying the features of this invention, parts of the top side being broken away to show internal detail.
Figure 4:
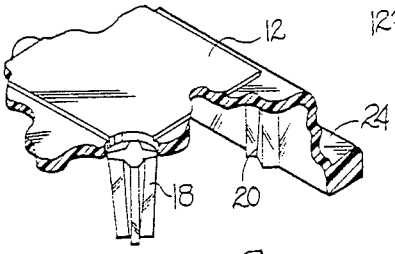
FIG. 4 is a perspective view of one maze containing module in assembled condition, parts being broken away to show internal detail.
Figure 4:
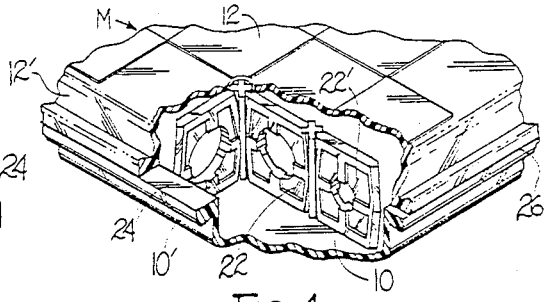

Refering now to the drawings, and most specifically to FIGS. 1, 2 and 4, the maze game of this invention includes a plurality of hollow containers referred to hereinafter as modules M. Each module includes a bottom tray 10 and a top tray 12 which may be releasably secured together by locking clips 14 or 16. As seen, each tray 10 and 12 includes a plurality of inwardly projecting posts 18 disposed at regularly spaced, equadistant positions in a regular grid like pattern, as seen in FIG. 1.

As shown in the preferred embodiment, each post 18 is configured with four regularly spaced open grooves 18' positioned at 90° intervals about its circumference, each groove arranged to face toward a similar groove associated with adjacent posts. Single grooves 20 are provided on the side walls 10', 12' of each tray member, and are positioned to correspond with the facing grooves 18' of adjacent posts. Maze wall panels 22 and 22' are configured to be inserted into the space between spaced apart post grooves 18', or post grooves 18' and wall grooves 20, the wall panels preferably arranged to fit snugly in the receiving grooves so that they are not likely to be inadvertently dislodged while assembling a maze.

Figure 3:
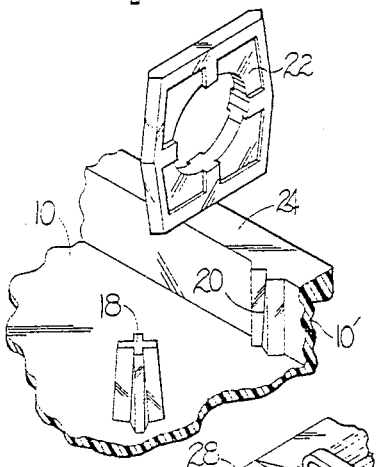
FIG. 3 is a fragmentary, exploded perspective view of one maze forming panel and its relationship to the panel mounting structure associated with each module.
Figure 7A:
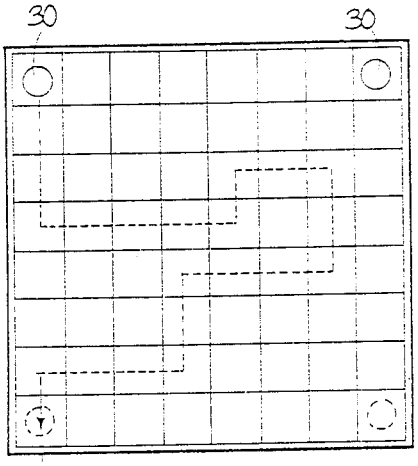
FIG. 7, comprising parts a and b, illustrate two maze containing modules, the one of FIG. *7a* to be disposed on top of the module of FIG. *7b* in use, a maze course involving the two levels being shown in broken lines to illustrate one example of a multi-level game.

As will be understood from FIG. 3, the inwardly projecting posts 18 on the opposite trays align with each other when the two trays are put together, and preferably are configured to be slightly shorter than the depth of the associated tray so that they do not touch end on end when the trays 10, 12 are put together. The small gap that remains between the aligned posts when the trays are put together assures full reception of the maze panels in the aligning grooves 18 and 20, and the snug fit of the panels in the grooves prevents inadvertent separation of the trays once a maze has been formed and the trays assembled to form a maze-containing module.

Although the posts 18 in the preferred embodiment are shown as having an "X" cross section and tapered grooves which receive the corresponding tapered edges of a panel, it is to be understood that any other suitable post and groove configuration and cooperating edge configuration may alternatively be provided as desired for simplicity of construction.

Figure 5:
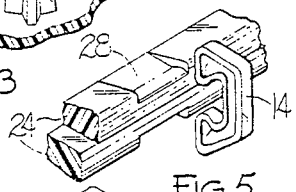
FIG. 5 is a fragmentary exploded perspective view of the edge of a module, the locking notch associated with the edge of the module, and one form of module locking clip in position for attachment to the module.
Figure 7B:
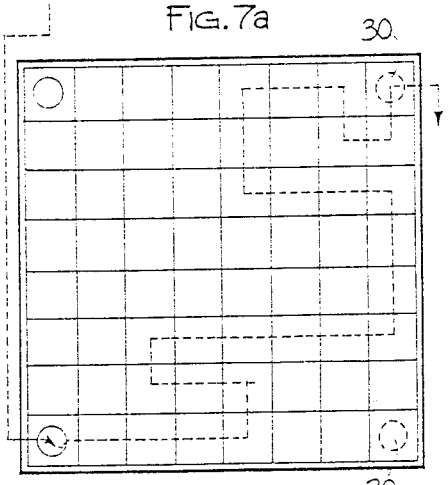

As illustrated, each tray 10, 12 includes an outwardly projecting lip portion 24 about the circumference of its side walls. Preferably, this lip portion is configured, as shown, to be thicker in cross section near its outer edge than at its inner edge. As shown in FIGS. 2 and 5, when the trays 10 and 12 are put together, the projecting lip portions abut each other and combine to form an edge rail 26 which projects outwardly.

Figure 2:
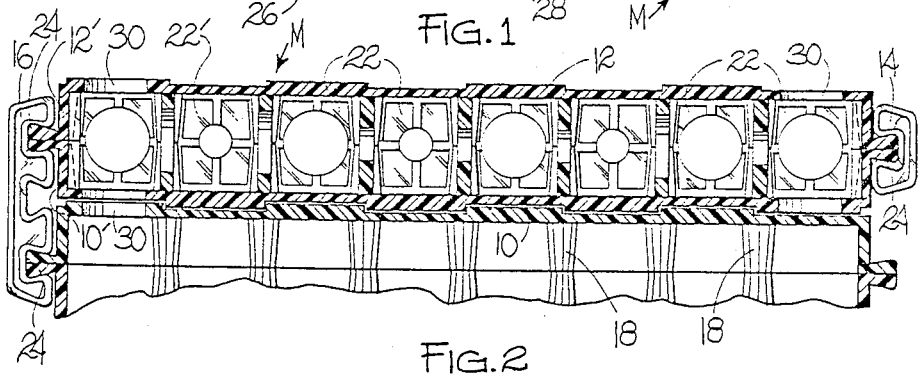
FIG. 2 is a fragmentary sectional view of the maze game of FIG. 1 taken along the line 2—2 in FIG. 1.

A tray locking clip 14, which may be of resilient or non-resilient material, is configured, as seen best at the right in FIG. 2, to engage the edge rail and securely hold the two lip portions 24 tightly together. Usually, two clips 14 are provided preferably on opposite sides of each module. The locking clips are preferably configured with a C-shaped interior portion, as shown, which conforms closely to the configuration of the rail 26 when the trays are placed together.

Since the edge rails are preferably thicker at their outside edge than at their inside edge, and the C-shaped clip would be difficult to snap over the edge rail, it is desirable that the rails include a notched portion 28 which eliminates the thickened portion so that the clip may be easily installed on and removed from each edge rail. This feature is shown most clearly in FIGS. 4 and 5. In order to lock the trays together, a clip 14 is placed on the edge rail at the notch 28, and then moved sideways in order to engage the contoured portion of the rail firmly and securely within the C-shaped interior portion of the clip. To remove the clip, it is necessary only to slide it to the notched portion, whereupon it is easily withdrawn from the rail. The notch 28 may, of course, be omitted if, for example, the clip 14 is resilient and does not require the notched out portion for installation.

Figure 6:
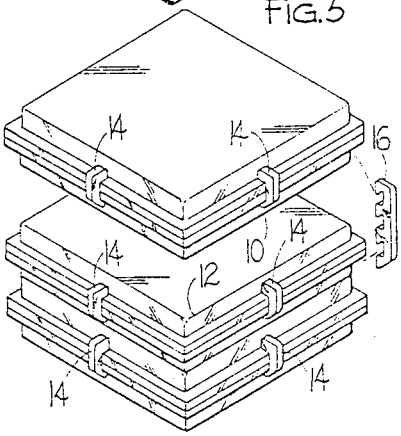
FIG. 6 is a schematic perspective view of a plurality of modules being assembled into a more extensive vertical stack.

Means is provided to lock individual maze containing modules together to form pairs of maze levels, and to secure vertically adjacent pairs together to form a stack. As seen in FIGS. 2 and 6, a locking clip 16 is configured essentially as a pair of connected and spaced apart clips 14 arranged to engage the edge rails of vertically stacked individual modules. The installation and removal of clip 16 is similar to clip 14.

Referring once again to the maze forming wall panels, FIG. 2 shows two distinct forms of panels 22 and 22'. Panel 22 includes a large opening through which an object ball (not shown) is permitted to pass. Panels 22' include a smaller opening which is preferably slightly larger than the diameter of the posts 18. This construction provides a three fold purpose: First, for packaging, in which all the panels are lain in connected strips in a tray with the post projecting through the openings; secondly, to afford increased visibility through each completed maze module; and thirdly, to tend to confuse a player seeking a pathway through the maze. Although it is desirable that this wall construction is provided, the invention is not limited to only such a construction. Alternatively, it is conceivable that a solid panel could be used in place of panel 22' if desired, and, although it is not preferred, it is possible that ball pass-through panels 22 could be omitted entirely, making maze pathways and false passageways more readily observable, and the game consequently less difficult.

Openings 30 are provided through each tray 10 and 12 at desired locations. In the embodiment illustrated, openings are provided at three of the corners of each tray 10, 12. This particular disposition of openings has been found to provide the most desirable combination of openings when the trays are assembled. With each tray having three openings adjacent the corners, the trays may be assembled preferably so that the blank corner of one tray 10 corresponds with a corner of the outer tray 12 having a hole through it. In this manner, two opposite corners of the completed module have one blank side and one open side, thereby allowing a ball to drop vertically into the level at one corner, and drop vertically downward out of the module at the opposite corner. The remaining two corners of course have aligning holes both top and bottom, through which a ball may pass, missing the next level altogether.

Such a pass-through could be used in a variety of ways in playing a game. For example, a maze course might follow a path from the first level to the third level and end on the second level or an automatic forfeiture of a game could result should a player take a wrong turn and the ball falls out of the stack through the aligned opening. These of course are details of potential game rules and bear no relevance to the invention itself.

Means is preferably provided to assist in the proper alignment of completed modules preliminary to their being secured together into pairs by locking clip 16. In this regard, FIG. 2 illustrates that the outer surface of each tray is preferably contoured in order to mate precisely with a corresponding contour of the outer surface of an adjacent tray. As illustrated best in FIGS. 1 and 2, portions of the grid pattern are raised on the outer surface of each tray. When two modules are placed together to form a pair and are in proper alignment with each other so that the locking clip 16 may engage the edge rails, the raised surface of one module is aligned with the lowered surface of the other tray and a positive engagement is achieved whereupon the joining clip 16 may be installed. In this manner the modules are prevented from slipping and sliding relative to each other and true alignment of the interconnecting openings 30 is definitely assured.

As will be understood, it is important that the modules be transparent in order that a player may see through the stack while he attempts to accomplish the inner mazes. it is also desirable, although not necessary, that one tray 10 or 12 although transparent be colored or otherwise marked so that the tray will not be inadvertently inverted during assembly of the stack and thereby not permit proper mating of the contoured surfaces of the modules of adjacent pairs.

From the foregoing description of the construction of the maze game of this invention the assembly and operation of the game is apparent: First, the trays are opened and the panels 22 and 22' are installed by sliding them into the grooves 18' and 20 of the posts 18 and side walls 12' respectively of the tray member 12 to form a desired maze path through the tray, such as is illustrated in FIG. *7a.* the top tray 10 is then installed over the tray 12, its panel-mounting grooves receiving the panels already installed in the lower tray 12. A second maze containing module is assembled in the same manner. A suggested course is shown in FIG. *7b.* Locking clips 14 are installed on each tray edge rail preferably on opposite sides as discussed earlier. One module (FIG. *7a*) is then positioned on top of the other module (*7b*) and oriented so that the desired openings align in the manner required by the particular maze configuration. The modules are moved relative to each other until the contoured surfaces of the modules engage each other to prevent further movement. At this point, the two modules are properly aligned, and the locking clips 16 are then installed as described, thereby firmly securing the two individual maze containing trays together, forming a pair. Additional levels may be formed in this manner, and added to the aforementioned secured pair individually or in already joined pairs utilizing locking clip 16 to secure adjacent pairs together as shown in FIG. 6. The maze game is then ready to play.

In use, an object ball (not shown) is dropped into the exposed opening of the top module at a corner designated as the beginning. The maze stack is then tilted and manipulated so that the ball is moved about. Where panels 22 are provided, the ball will pass through the large opening as the game is tilted. Where panels 22' are installed, the ball of course cannot pass.

Upon successful completion of the maze in the first level (FIG. *7a*) the ball enters the corner portion of the module and falls through the opening in the bottom of the upper level and through the aligned opening in the top of the next level (FIG. *7b*). Upon successfully manuevering the maze in the second level, the player will have moved his ball to an opening in the bottom of that module whereupon the ball will either fall out to designate a win, or, should successive levels be present, to the next lower level.

As a player proceeds to deeper and deeper levels in a stack, the complexity of the game increases as it becomes more difficult to distinguish maze paths by looking through preceding levels of wall-filled modules. Accordingly, the simple marble maze concept is brought to a new level of complexity, intrigue and frustration. As a person becomes more adept at analyzing multi-dimensional maze work, he is always posed the challenge presented by adding more levels of mazes. Indeed, multi-dimensional mazes such as described even contemplate the possibility of maze path that require an individual to go from one level to the next to the next and back up again in the opposite direction before completing a single, highly complex course. The combinations and variations that are potentially available are virtually endless, and the game of this invention can provide an extensive and intricate maze work in a very compact unit.

From the foregoing it will be apparent to those skiled in the art that various changes other than those previously described may be made in the size, shape, type, number and arrangement of parts described hereinbefore without departing from the spirit of this invention and the scope of the appended claims.

Having thus described my invention and the manner in which it may be used, I claim:

1. A maze game comprising:

(a) at least two hollow container modules, each module containing a maze pathway through its interior, each module including a top tray member and a bottom tray member, each member mounting a plurality of spaced apart grooved posts disposed for axial alignment with the posts of the other tray member when the two members are put together to form a container module, laterally adjacent posts configured to receive between them removable maze-forming panels having edges arranged to be captured in the grooves of the spaced apart posts, whereby a maze pathway can be formed by positioning the panels in a selected arrangement, (b) at least two openings in each module, one opening arranged through the top of the module to permit entrance of an object ball to the interior of the module and the other opening arranged through the bottom of the module to permit an object ball to exit the module, and (c) locking means configured to releasably engage each module to secure the modules together in a vertically stacking condition one upon the other, whereby said one opening through the top of the one module is maintained in alignment with the opening through the bottom of the other module disposed on top of the one module, whereby to permit passage of an object ball from the upper module level to the lower module level upon completion of the maze pathway associated with said upper module level.

2. The maze game of claim 1 wherein each said tray member includes an outwardly projecting lip member about its peripheral side walls, the lip members of adjoining tray members configured to meet each other and form an edge rail when the two tray members are placed together to form a module, and including tray member locking means comprising at least one clip configured to engage said edge rail to secure the opposite lip members together and thereby secure the module against inadvertent separation of the tray members.

3. The maze game of claim 2 wherein the locking means securing the modules together in stacked condition comprises a locking clip configured to engage the edge rails of vertically adjacent modules in a stack.

4. The maze game of claim 3 wherein the top and bottom tray members include a contoured outer surface configured to engage each other and secure against movement of one module relative to the other when the bottom surface of one module is in aligned contact with the top surface of a vertically adjacent module, whereby to facilitate the securing of a plurality of modules together in a vertical stack and assuring proper alignment of the interconnecting openings of adjacent modules.

5. The maze game of claim 1 wherein the top and bottom tray members include a contoured outer surface configured to engage each other and secure against movement of one module relative to the other when the bottom surface of one module is in aligned contact with the top surface of a vertically adjacent module, whereby to facilitate the securing of a plurality of modules together in a vertical stack and assuring proper alignment of the interconnecting openings of adjacent modules.

6. The maze game of claim 1 wherein each said tray member includes an outwardly projecting lip member about its peripheral side walls, the lip members of adjoining tray members configured to meet each other and form an edge rail when the two tray members are placed together to form a module, and said locking means securing the modules together in stacked condition comprises a locking clip configured to engage the edge rails of vertically adjacent modules in a stack.

* * * * *